US005722278A

United States Patent [19]

Horino et al.

[11] Patent Number: 5,722,278

[45] Date of Patent: Mar. 3, 1998

[54] ROLL FORMING APPARATUS

[75] Inventors: Katuyoshi Horino, Nagoya; Mitsuhiro Ozawa, Hekinan; Norio Nishikawa; Teruhiko Sato, both of Kariya; Atsushi Shiji, Anjo; Takashi Wada, Hekinan, all of Japan

[73] Assignees: Aisin Seiki Kabushiki Kaisha; Chubo Engineering Kabushiki Kaisha, both of Aichi-pref, Japan

[21] Appl. No.: 787,877

[22] Filed: Jan. 23, 1997

Related U.S. Application Data

[63] Continuation of Ser. No. 309,474, Sep. 21, 1994, abandoned.

[30] Foreign Application Priority Data

| | | | |
|---|---|---|---|
| Sep. 21, 1993 | [JP] | Japan | 5-259140 |
| Sep. 21, 1993 | [JP] | Japan | 5-259141 |
| Sep. 21, 1993 | [JP] | Japan | 5-259142 |

[51] Int. Cl.[6] ..... B21D 5/08

[52] U.S. Cl. ..... 72/8.3; 72/11.1; 72/181; 72/182

[58] Field of Search ..... 72/176–179, 181, 72/182, 224, 225, 8.3, 10.1, 11.1

[56] References Cited

U.S. PATENT DOCUMENTS

| | | | |
|---|---|---|---|
| 1,397,271 | 11/1921 | Eckenroth | 72/182 |
| 1,673,787 | 6/1928 | Frahm | 72/181 |
| 4,656,858 | 4/1987 | Addison | 72/176 |
| 4,716,754 | 1/1988 | Youngs | 72/178 |

FOREIGN PATENT DOCUMENTS

| | | | |
|---|---|---|---|
| 154222 | 6/1988 | Japan | 72/181 |
| 2-35605 | 8/1990 | Japan . | |
| 253515 | 9/1992 | Japan | 72/224 |
| 721141 | 3/1980 | U.S.S.R. | 72/178 |

*Primary Examiner*—Daniel C. Crane
*Attorney, Agent, or Firm*—Hazel & Thomas

[57] ABSTRACT

A roll forming apparatus incorporates tension rolls which feed a material along a longitudinal direction thereof. The tension rolls are arranged at predetermined intervals and are driven. Also, forming rolls which form the fed material are arranged alternatingly on both sides in the width direction of the material between adjacent tension rolls. The roll forming apparatus described above prevents scratches on the material from forming as a result of the material sliding on the forming rolls.

15 Claims, 11 Drawing Sheets

ROLL FORMING APPARATUS

This application is a continuation of application Ser. No. 08/309,474, filed Sep. 21, 1994, now abandoned.

BACKGROUND OF THE INVENTION

1. Field of the Invention

The present invention relates to a roll forming apparatus for forming a gradual changing sectional shaped metallic molding, such as door frame and others, whose sectional shape gradually changes in a longitudinal direction. The roll forming apparatus is provided with a roll transfer apparatus for controlling the position and angle of rolls corresponding to the position of the member to be formed and the angle to its supply direction, and a roll attitude control apparatus for controlling an attitude within the perpendicular plane determined by the height and gradient of the forming roll corresponding to the height and gradient angle of the member to be formed.

2. Description of the Prior Art

In a roll forming apparatus (Japanese Pat. Laid-Open Pub. No. 2-35605) according to the prior art, as shown in FIGS. 10 and 11, stationary rolls FR are provided in one of the width directions of a material W to be formed. Movable rolls MR are transferred and controlled in a width direction within a perpendicular plane thereof by a first motor M1 and rotated around an axis of rotation by a second motor M2 opposite to each other, and are provided to the other of the width directions of the material W to be formed. Both of the stationary rolls FR and the movable rolls MR described above are rotated and driven so as to feed the material W to be formed in one direction of a longitudinal direction thereof while the material W is being formed.

Since the prior art roll forming apparatus described above allows only the other movable roll MR of the opposing rolls to transfer the material W to be formed, in the width direction thereof, there exists the problem that both edges in the width direction of the material W to be formed when formed can not be gradually changed.

Since the stationary rolls FR and the movable rolls MR are provided so as to oppose to each other in the prior art roll forming apparatus described above, there exists the problem that the opposing stationary and movable rolls FR and MR interfere with each other, resulting in an inability to form when a narrow material to be formed was tried to be formed.

In the prior art roll forming apparatus (Japanese Pat. Laid-Open Pub. No. 2-35605) described above, as shown in FIGS. 10 and 11, a stand ST for supporting the axis S of rotation integrated into the movable rolls MR provided opposing the stationary rolls FR is rotated and driven centering on an axis of rotation thereof through a rotating plate P by the first motor M1. Further, the positions and angles of the movable rolls MR and the same of the movable rolls MR on the horizontal faces are both controlled by transferring the movable rolls MR described above in the width direction of the material W to be formed through the axis of rotation S by means of the second motor M2.

Since the prior art roll forming apparatus described above controls both of the movable rolls MR and the position in the width direction of the material W to be formed corresponding to the formed member of the material W to be formed by means of the second motor M2 supported by the stand ST rotated and driven by the first motor M1 through the rotating plate P, a contact point of the movable rolls MR with the material W to be formed is deviated from the shaft center of the rotating plate P as a rotating center of the movable rolls MR. Therefore, there exists the problem that once the movable rolls are rotated, the forming position was deviated accordingly.

Furthermore, since the prior art roll forming apparatus can respond to the angular variation of an end face corresponding to the width of the material W to be formed within the horizontal face thereof and the feed direction of the material W to be formed, but not at all to the torsion and warp of the material W to be formed in a longitudinal direction thereof, the height corresponding to the marginal wave and the gradient of its vertical direction (i.e., upper or lower direction), that is, the attitude within the perpendicular plane, there exists the problem that the section of the material to be formed can not be gradually changed in a height direction thereof. In addition to this, there are the problems that it is necessary to respond to pass line changes and flower changes when a new forming roll is arranged for responding to those changes in order to give flexibility to the apparatus.

SUMMARY OF THE INVENTION

It is a general object of this invention to make forming and gradual changing of both ends of a material W to be formed in a width direction thereof, and to prevent scratches on the material W to be formed as a result of the sliding of the forming rolls.

It is a more specific object of the invention to make forming and gradual changing of both ends of a material W to be formed in a width direction thereof, and to prevent scratches on the material W to be formed as a result of the sliding of the forming rolls.

It is a more specific object of the invention to make is possible to form a narrow-sized material to be formed.

It is another object of the invention to prevent the deviation of a forming position which is a contact point of the material to be formed with a forming roll accompanying the rotation of the forming rolls.

It is still another object of the invention to make it possible to form a section which gradually changes in a height direction thereof.

It is a further object of the invention to make it unnecessary to prepare new forming rolls in response to the torsion, warp and marginal wave phenomena of the material to be formed in a longitudinal direction thereof thereby making it possible to correspond to a pass line change and a flower change and to make the situation of the roll forming apparatus flexible.

It is a still further object of the invention to provide a roll forming apparatus based on the concept of feeding the material to be formed to one of the longitudinal directions by driven tension rolls and also forming the material with forming rolls between the neighboring driving tension rolls and alternately to the right or left along the width direction of the material to be formed.

It is another object of the invention to provide a roll forming apparatus equipped with a roll transfer apparatus based on the concept of supporting the forming roll so as to correspond a contact point of the forming roll with the material to be formed on the axis of rotation of a rotary driving mechanism for controlling an angle of the forming rolls, and also transferring and controlling such a supporting apparatus and the rotary driving mechanism in the width direction of the material to be formed.

A further object of this invention is to provide a roll forming apparatus equipped with a roll transfer apparatus based on the concept of controlling the height and gradient angle of the forming rolls corresponding to the height of the material to be formed and the gradient in the perpendicular direction thereof.

A still further object of this invention is to provide a roll forming apparatus comprising: tension rolls for feeding a material to a longitudinal direction thereof, arranged at predetermined intervals and being driven; and forming rolls for forming said fed material, rotatively supported and arranged alternately on both sides in the width direction of said material between said adjacent tension rolls.

An even further object of this invention is to provide a roll forming apparatus further comprising a roll transfer apparatus that incorporates: a rotary drive mechanism for controlling an angle of forming rolls centering on an axis of rotation thereof; a supporting apparatus for said forming rolls and said rotary drive mechanism so as to correspond the axis of rotation in said rotary drive mechanism to a contact point of said forming rolls with said material to be formed; and a linear transfer mechanism for transferring said supporting apparatus and said rotary drive mechanism to the width direction of said material to be formed.

A yet further object of this invention is to provide a roll forming apparatus comprising a roll attitude control apparatus comprising: a height adjusting apparatus for adjusting the height of said forming rolls corresponding to a height of a forming portion of the material to be formed; and a gradient adjusting apparatus for adjusting the gradient angle of said forming rolls corresponding to the inclined angle of the formed member of the material to be formed within a perpendicular plane thereof.

A roll forming apparatus of the invention feeds a material to be formed to one of the longitudinal direction by tension rolls arranged at predetermined intervals, rotated and driven, and carries out the roll forming and gradual change of the both ends in the width direction of the material to be formed by a driven forming roll provided between the tension rolls placed side by side and alternately to the right or left in the width direction of the material to be formed.

In the roll forming apparatus of the invention, the linear drive mechanism described above transfers the supporting apparatus described above corresponding to the width of the material to be formed, and the angle of the forming rolls is controlled by the rotary drive mechanism described above while centering on an axis of rotation which corresponds to a contact point of the forming roll with the material to be formed on the supporting apparatus corresponding to the angle in the feed direction of the end face of the material to be formed.

Furthermore, the roll forming apparatus of the invention corresponds to the variations in height and gradient of the formed member in the material to be formed, adjusts the height of the forming roll by a height adjusting mechanism while taking consideration of the torsion, warp and marginal wave phenomena of the material to be formed in the longitudinal direction thereof, and controls the attitude of the forming roll within the perpendicular plane thereof by adjusting the gradient angle of the forming rolls on the basis of the gradient adjusting mechanism.

A roll forming apparatus of the present invention has the effect of preventing the formation of scratches by preventing the sliding of the material to be formed on the forming rolls, since the forming rolls for carrying out roll-forming were driven by the driving feed of the material to be formed with the aid of the tension rolls.

The roll forming apparatus of the invention has the effect of making it possible to gradually change by forming both ends of the material to be formed in the width direction thereof and further to form a narrow-sized material, since the roll forming apparatus of the invention is formed by the forming rolls provided between the neighboring tension rolls side by side and alternately to the right or left in the width direction of the material to be formed.

The roll forming apparatus of the invention has the effect of preventing the deviation of the forming position which should be a contact point of the forming rolls accompanied by the rotation of the forming rolls with the material to be formed, since a contact point of the forming roll with the material to be formed corresponds to an axis of rotation when the forming rolls transfer corresponding to the width of the material to be formed and the angle of the end face.

Furthermore, the roll forming apparatus of the invention has the effect of making it unnecessary to build new forming rolls, and of being capable of responding to the pass line change and flower change, since the roll forming apparatus makes it possible to gradually change the roll forming corresponding to the variations in height and gradient of the formed member of the material to be formed and to control the height and gradient of the forming rolls in consideration of the torsion, warp and marginal wave phenomena of the material to be formed in its longitudinal direction.

DETAILED DESCRIPTION OF THE PREFERRED EMBODIMENTS

Referring now to the preferred embodiments of the invention, the detailed description of the invention will be specifically given in the following according to the accompanying drawings.

EMBODIMENT 1

Figure 1:
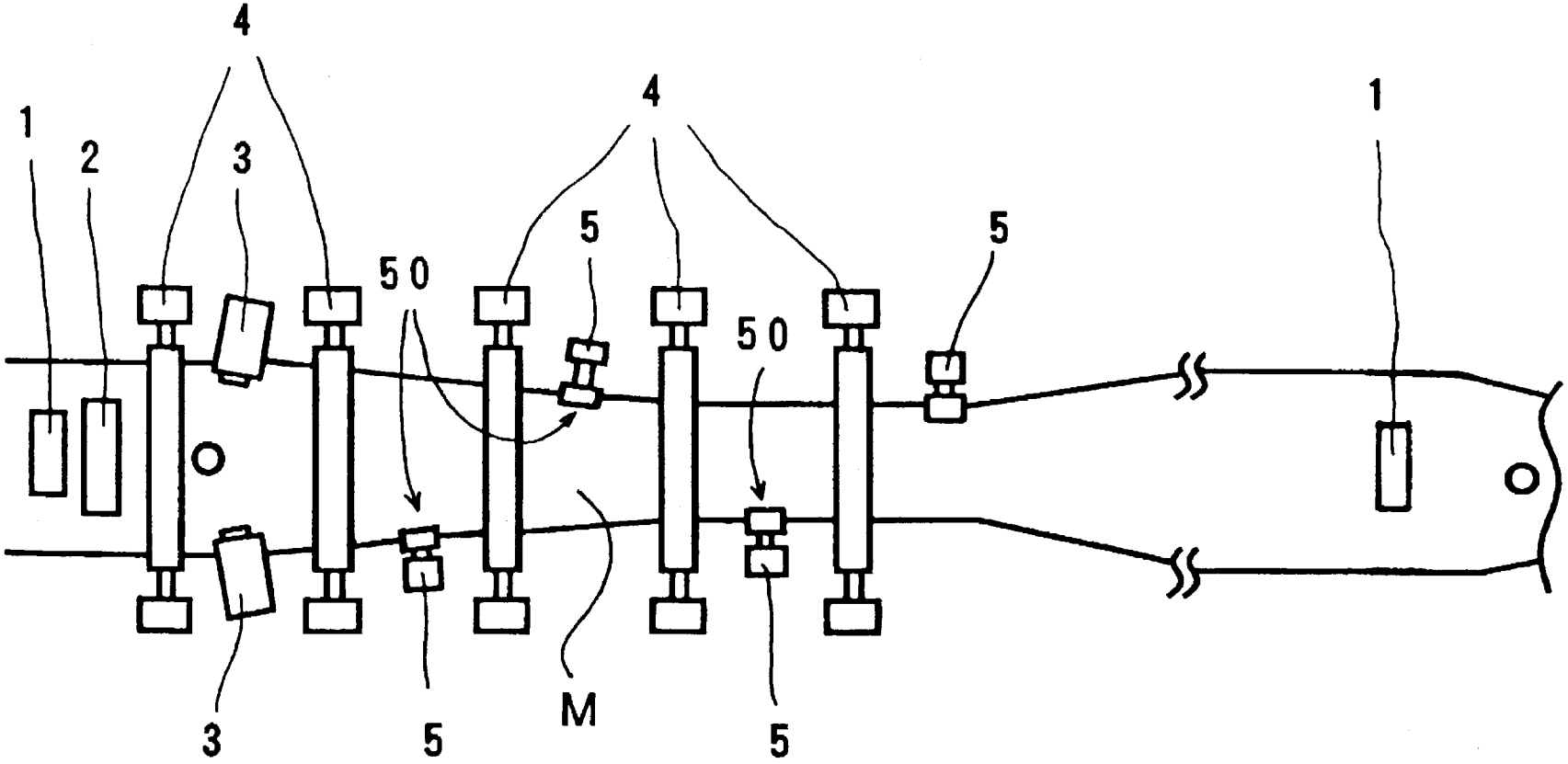
FIG. 1 is plan view showing each apparatus as a first through a third preferred embodiment of the invention.
Figure 2:
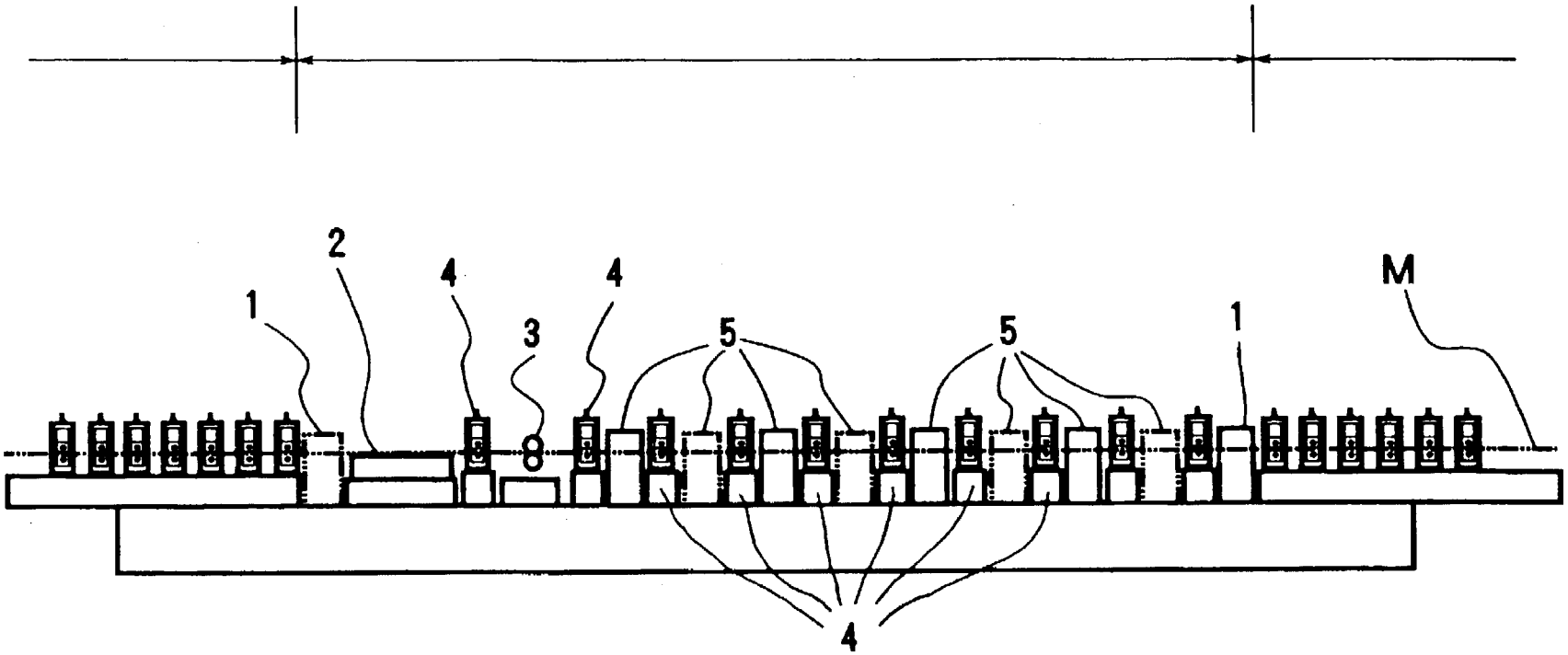
FIG. 2 is a side view showing each apparatus as a first through a third preferred embodiment of the invention.

As shown in FIGS. 1 through 7, a roll forming apparatus of a first preferred embodiment comprises a measuring unit 1 for measuring a formed length of a formed material by gradually changing the cross sectional area thereof i.e., a gradual section changed material; a pierce unit 2 for perforating a gradual changing and trimming standard hole; a gradual changing and trimming unit 3 for forming a gradual changing flange; a plurality of tension units 4 having a pair of driven rolls for clamping the material, and feeding the gradual section changed material provided a predetermined interval to the right side in FIG. 1; and a plurality of gradual changing servo units 5 for adjusting a position and an angle of a forming roll 50, which is provided between the tension rolls 41 and 42 of the neighboring tension unit and alternately to the right or left in the width direction of the molding M.

Figure 3:
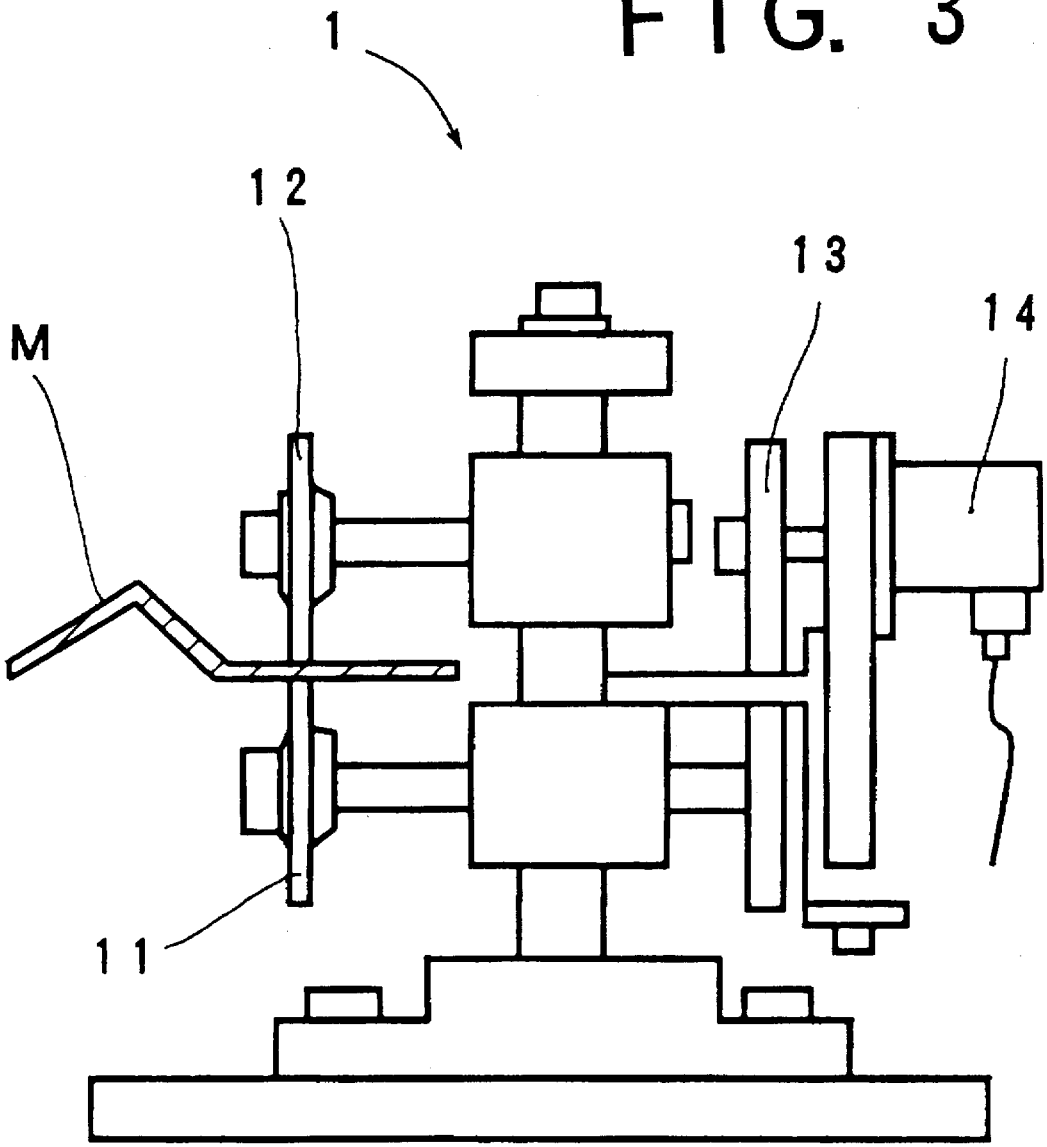
FIG. 3 is a front view showing a measuring unit as a first through a third preferred embodiment of the invention.

The measuring unit 1 provided to the most upstream of the gradual section changing and forming portion as shown in FIG. 3, comprises upper and lower rotary plates 11 and 12 for clamping half-formed molding M forming both a constant sectional portion and a forming standard face of the molding M as a plate material, i.e., a material to be formed, by a basic forming portion; and an encoder 14 for rotating itself and communicating to the lower rotary plate 11 through a belt 13, and outputs signals after detecting the forming length of the molding M.

Figure 4:
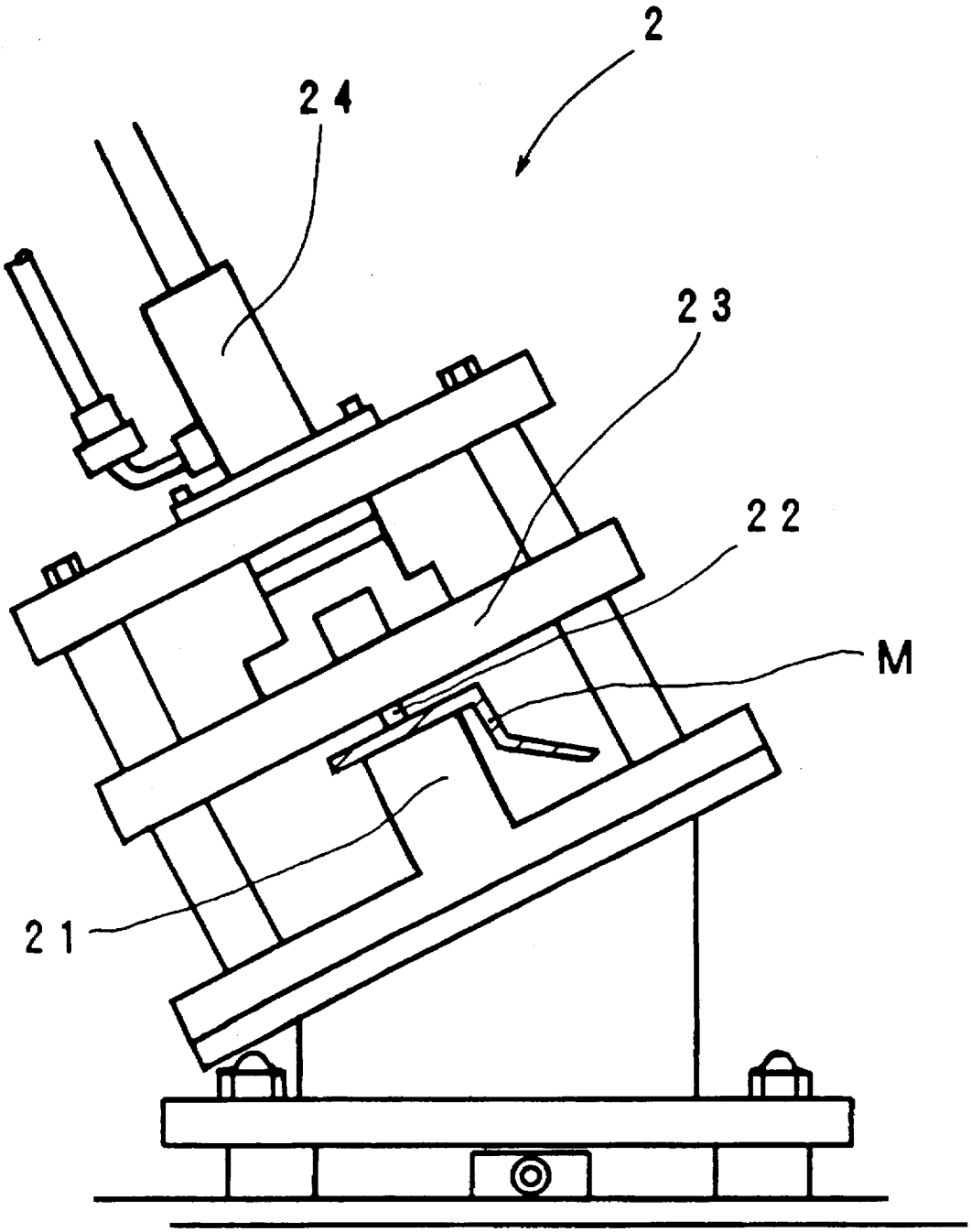
FIG. 4 is a front view showing a pierce unit as a first through a third preferred embodiment of the invention.

As shown in FIG. 4, the pierce unit 2 provided downstream of the measuring unit 1, comprises: a die 21 for mounting a molding M thereon; a punch 22 placed opposite to the die 21; a clamp 23 for locking the punch 22; and an air cylinder 24 for moving vertically the clump 23, that carries out a pierce processing based on the signals from the measuring unit 1, and perforates a round standard hole on the center line of the molding M with a constant pitch.

Figure 5:
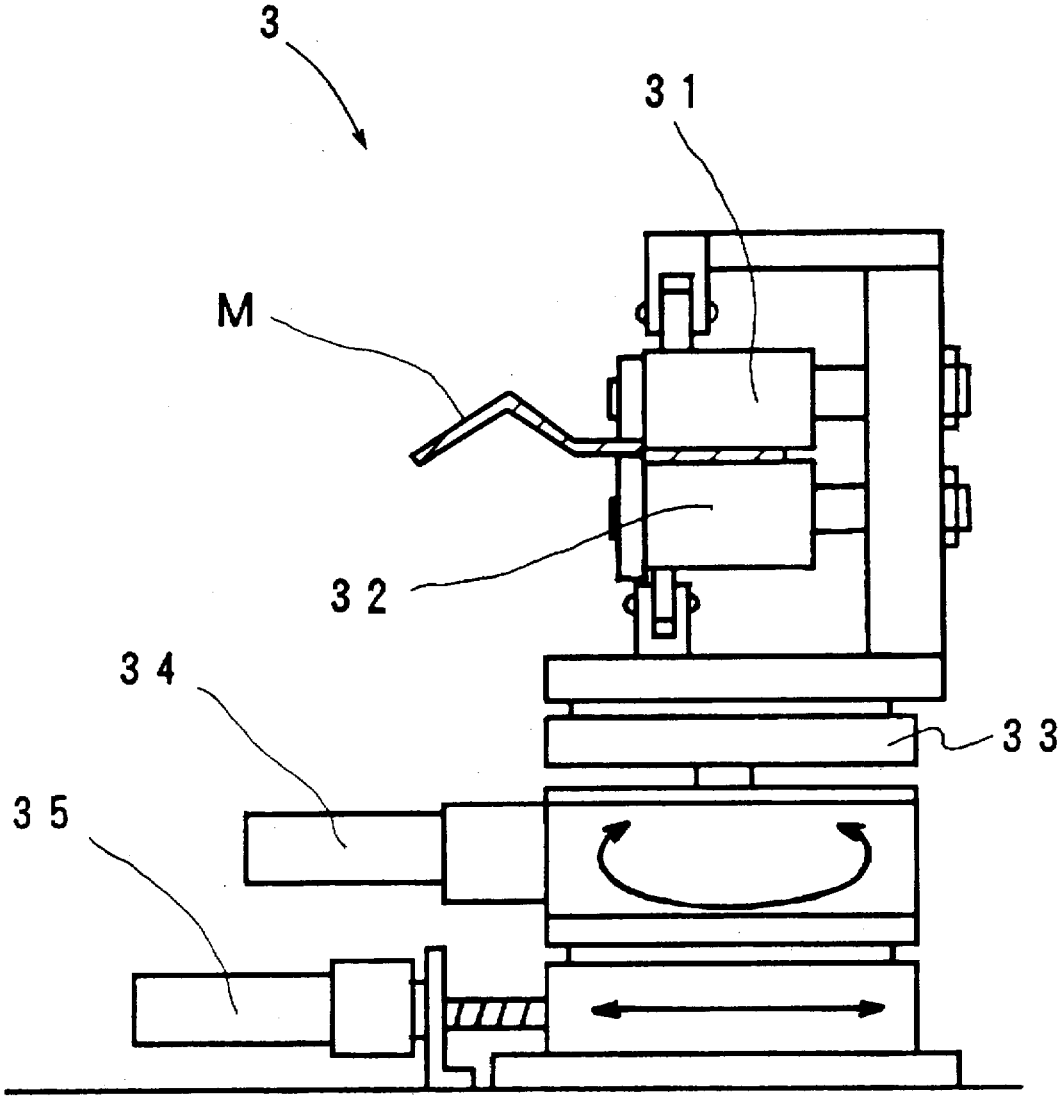
FIG. 5 is a front view showing a gradual changing trimming unit as a first and a third preferred embodiment of the present invention.

As shown in FIG. 5, the gradual changing and trimming unit 3 comprises: upper and lower roll cutters 31 and 32 for clamping the molding M, a rotary servo motor 34 for rotating and controlling a rotary plate 33 mounting an apparatus for supporting the roll cutters 31 and 32, a linear servo motor 35 for controlling a position in the width direction of the molding M of the rotary plate 33 and a controller. The gradual changing and trimming unit 3 detects the standard hole position of the molding M to calculate both a flange face position of the molding M to be gradually changed and the forming velocity signal of the molding M. Then, the gradual changing and trimming rolls rotate within the angle of several tens of degrees while sliding the width direction of the molding M so as to carry out the processing of the molding into a gradual changing flange.

Figure 6:
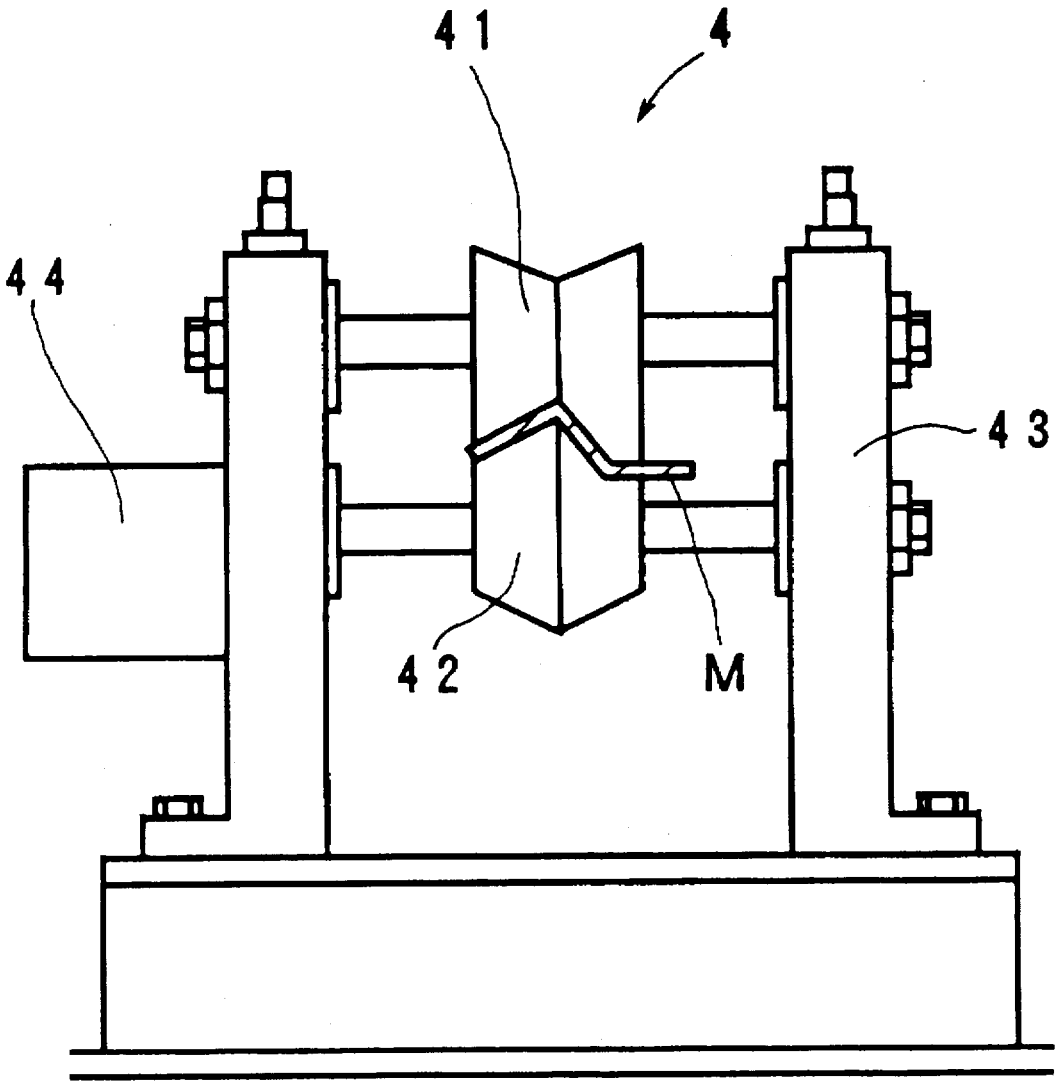
FIG. 6 is a front view showing a tension unit as a first through a third preferred embodiment of the invention.

As shown in FIG. 6, the tension unit 4 comprises: the upper and lower rolls 41 and 42 for clamping the molding M, a stand 43 for supporting the upper and lower rolls rotatably and a drive portion 44 comprising a drive motor for driving the lower roll 42, feeds the molding M to the right side in FIG. 1, and provides the forming of a constant section area and tensile force to the molding M by means of the upper and lower rolls 41 and 42 in order to secure a forming balance thereof, resulting in preventing the slack of the molding M as a plate material.

Each tension unit 4 at a first or second stage provided upstream or downstream of the gradual changing and trimming unit 3 operates as a trimming tension unit and prevents the slack produced by the gradual changing trimming.

Figure 7:
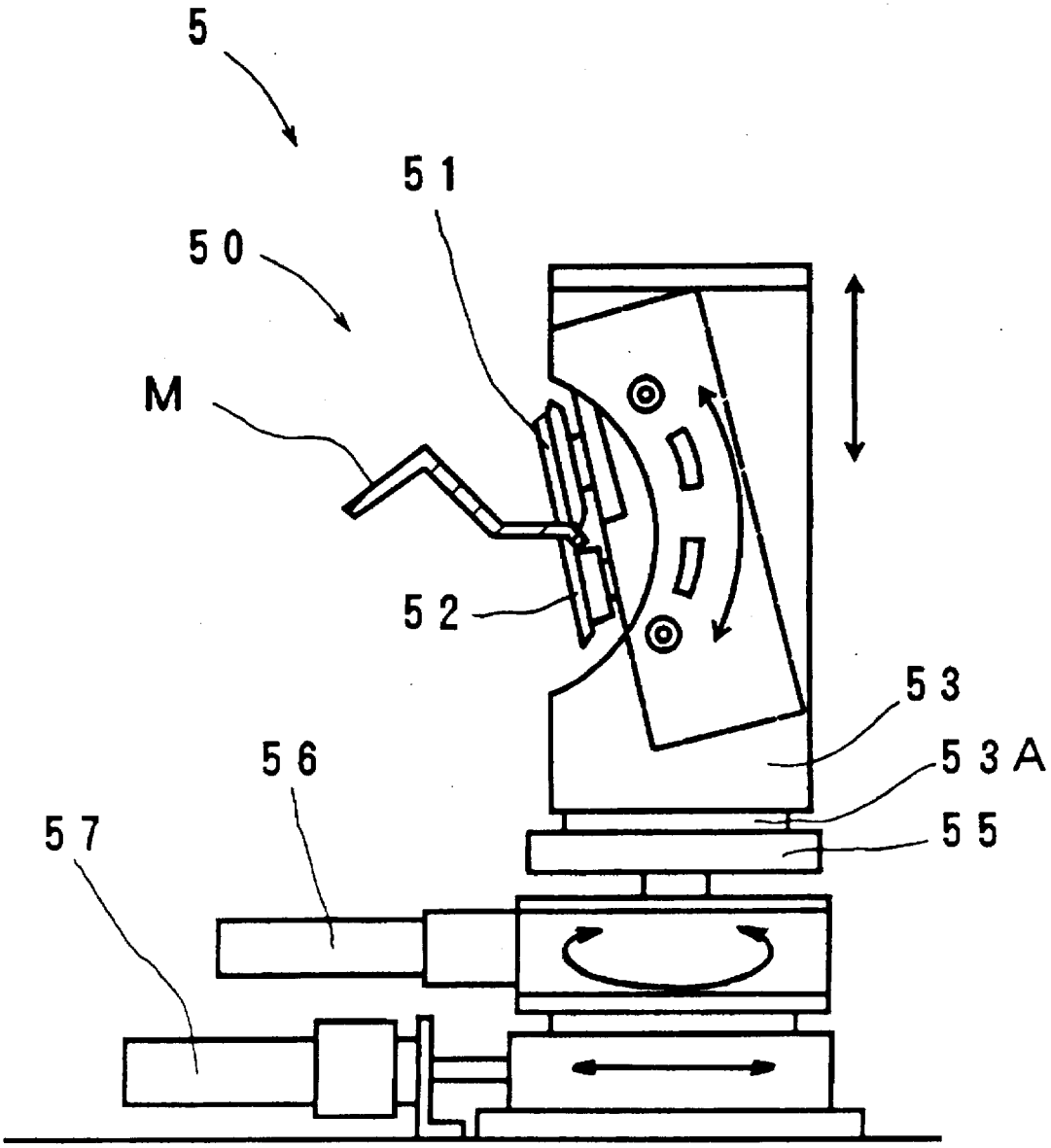
FIG. 7 is a front view showing a gradual changing servo unit as a first through a third preferred embodiment of the invention.

As shown in FIGS. 7, the gradual changing servo unit 5 comprises: upper and lower gradual changing rolls 51 and 52 constituting the forming rolls to clamp the molding M in a rotatably supported manner, a rotary servo motor 56 for controlling a rotation of a rotary plate 55 which supports a supporting portion 53 to freely support the gradual changing forming rolls 51 and 52, in a height and at an angle through a spacer 54, and a linear servo motor 57 for controlling the position of the molding M of a rotary plate in its width direction. The linear servo motor 57 includes a controller and a detection sensor with the detection sensor detecting the standard hole of the molding M and the upper and lower gradual changing rolls 51 and 52 rotating without driving within the angles of several tens of degrees while sliding in the width of the molding M in order to form the gradual changing section of the molding M. The upper and lower rolls 51 and 52 are rotated by the movement of the molding M in the longitudinal direction thereof.

The measuring unit 1 provided to the final forming portion for finishing the gradual changing sectional forming makes it possible to compensate for the slide and rotating angle of the gradual changing servo unit 5 by measuring the pitch of the standard hole formed by pierce processing to calculate its elongation of the molding M and to feed back the percentage of elongation (%) to the controller of the gradual changing servo unit 5.

In the roll forming apparatus of the first preferred embodiment having the above construction, when a half-formed molding M formed in a constant section and the forming standard face of a plate-like molding M is supplied in its basic forming portion, the encoder 14 in the measuring unit 1 measures a formed length, inputs the resulting signal into the pierce unit 2, and forms a standard hole into the molding M by pierce processing by means of a punch 22 of the pierce unit 2 and a die 21.

The trimming unit 3 detects the position of a standard hole of the molding M and calculates both a flange face position of the molding M to be gradually changed and a forming velocity signal of the molding. The molding M is formed into a gradual changing flange by rotating the roll cutters 31 and 32 composed of the gradual changing trimming rolls within the angle of several tens of degrees while sliding in the width direction of the molding M.

The tension unit 4 furthest upstream and composed of a trimming tension unit affords a constant tension to the molding M in order to prevent the slack produced at the time of forming the gradual changing flange.

The forming rolls 51 and 52 in the gradual changing servo unit 5 are provided between the neighboring tension units 4 side by side and alternately to the right or left in the width direction of the molding M. The forming rolls 51 and 52 slide in the width direction of the molding M through the linear servo motor 57 by detecting a standard hole of the molding M by means of the detection sensor. The forming rolls 51 and 52 carry out the forming of the gradual changing section of the molding M by being rotated within several tens of degrees by the rotary driving mechanism 56 in correspondence with the angles of the side end face of the molding M. Incidentally, in the present preferred embodiment, the gradual changing servo units 5 are arranged one by one alternately to the right or left in the width direction thereof, but there is no problem even if a plurality of gradual changing servo units are arranged to only side of it.

The neighboring tensions units 4 side by side at this time form a constant section for securing its forming balance, and remove the slack of the molding M by clamping the gradual changing servo unit 5 and affording a constant tensile force to the molding M by means of the upper and lower rolls 41 and 42.

The measuring unit 1 arranged at the position after the gradual changing and sectional forming is over can also correct the slid quantity and rotating angle of each gradual changing servo unit 5 corresponding to the percentage of elongation obtained by measuring the pitch of a standard hole, calculating the elongation accompanied by the gradual changing formation of the molding M and feeding back the resulting percentage of elongation to each gradual changing servo unit 5.

Still further, the apparatus of the first preferred embodiment makes it possible to form and gradually change both end portions of the molding M in the axial direction thereof and to allow the gradual changing roll unit 50 to form a narrow-sized molding M as well, since the gradual changing servo units 5 are arranged between the neighboring tension units to each other and alternately to the right or left in the width direction of the molding M.

In addition, the apparatus of the first preferred embodiment prevents the sliding of the upper and lower gradual changing rolls 51 and 52 on the molding M and then inhibits the formation of scratches accompanied by the above sliding, since the supply of the molding M is carried out by the upper and lower rolls 41 and 42 in the tension unit 4. The upper and lower gradual changing rolls 51 and 52 for carrying out the gradual changing forming are arranged to be of a driven type of undrivability.

Furthermore, the roll attitude control apparatus in the roll forming apparatus of the first preferred embodiment enables a stable forming since the above-mentioned gradual changing rolls 51 and 52 in the gradual changing servo unit 5 accompany and rotate by the transferring of the molding M due to a driven type. Accordingly, the gradual changing rolls 51 and 52 are positioned in parallel with the formed face at a time of gradual changing section forming.

Moreover, the roll attitude control apparatus in the roll forming apparatus of the first preferred embodiment gives the effect of making it possible to improve the accuracy in section by carrying out the gradual changing section forming along the gradual changing flange, since each gradual servo unit 5 is feedback controlled corresponding to the variations in the percentage of elongation monitored when any elongation is generated by the gradual changing forming and both the slid quantity and the rotating angle of the gradual changing rolls 51 and 52 are corrected thereby.

Furthermore, the roll forming apparatus of the first preferred embodiment makes it possible to form the section gradually changing in a height direction thereof and to respond readily to a pass line change and a flower change for solving the torsion, warp and marginal wave phenomena of the molding M in a longitudinal direction thereof. In addition, the apparatus is flexible, requiring no production of new gradual changing rolls, reducing the stages of the gradual changing rolls, and improves the accuracy in each dimension of the products, since the gradual changing rolls 51 and 52 are supported to the supporting portion 53 ascendably, descendably and inclinably.

EMBODIMENT 2

As shown in FIGS. 1 through 8, a roll forming apparatus of a second preferred embodiment comprises a measuring unit 1 for measuring the formed length of a gradual section changed material; a pierce unit 2 for perforating a gradual changing and trimming standard hole; a gradual changing and trimming unit 3 for forming a gradual changing flange; a plurality of tension units 4 having a pair of driven rolls for clamping the material, and for feeding the gradual section changed material provided a predetermined interval to the right side in FIG. 1; and a plurality of gradual changing servo units 5 provided with a roll transfer apparatus. The roll transfer apparatus comprises a supporting apparatus 53 for supporting forming rolls 50 and a linear transfer mechanism 57T for transferring the supporting apparatus 53 in the width direction of a molding M so as to correspond a contact point of a rotary drive mechanism 56 to control an angle of a forming roll 50. The forming roll 50 is provided between the tension rolls 41 and 42 of the neighboring tension unit and alternately to the right or left in the width direction of the molding M, i.e., a gradual section changed material, while centering on an axis of rotation thereof with both the forming rolls 50 and the molding M, to the axis of rotation.

The measuring unit 1 provided at the most upstream of the gradual section changing and forming portion as shown in FIG. 3, comprises upper and lower rotary plates 11 and 12 for clamping half-formed molding M to form both a constant sectional portion and a standard face of the molding M as a plate material, i.e., a material to be formed, through a basic forming portion; and an encoder 14 for rotating itself and communicating to the lower rotary plate 11 through a belt 13. The measuring unit 1 outputs signals after detecting the forming length of the molding M.

As shown in FIG. 4, the pierce unit 2 provided downstream of the measuring unit 1, comprises: a die for mounting a molding M thereon; a punch 22 placed opposite the die 21; a clamp 23 for locking the punch 22; and an air cylinder 24 for moving vertically the clamp 23. The pierce unit 2 carries out pierce processing based on the signals from the measuring unit 1, and perforates round standard holes on the center line of the molding M at a constant pitch.

As shown in FIG. 5, the gradual changing and trimming unit 3 comprises: upper and lower roll cutters 31 and 32 for clamping the molding M, a rotary servo motor 34 for rotating and controlling a rotary plate 33 mounting an apparatus for supporting the roll cutters 31 and 32, a linear servo motor 35 for controlling a position in the width direction of the molding M of the rotary plate 33 and a controller, and detects the standard hole position of the molding M to calculate both a flange face position of the molding M to be gradually changed and the forming velocity signal of the molding M. Then, the gradual changing and trimming rolls rotate within the angle of several tens of degrees while sliding in the width direction of the molding M so as to carry out the processing of the molding into a gradual changing flange.

As shown in FIG. 6, the tension unit 6 comprises: the upper and lower rolls 41 and 42 for clamping the molding M, a stand 43 for supporting the upper and lower rolls rotatably and a drive portion 44 comprising a drive motor for driving the lower roll 42. The tension unit 6 feeds the molding M to the right side in FIG. 1, and provides the formation of a constant section area and tensile force to the molding M by means of the upper and lower rolls 41 and 42 in order to secure a forming balance thereof, resulting in preventing the slack of the molding M as a plate material.

Each tension unit 4 at a first or second stage provided to the upstream or downstream of the gradual changing and trimming unit 3 has an effect as a trimming tension unit and prevents the slack produced by the gradual changing trimming.

Figure 8:
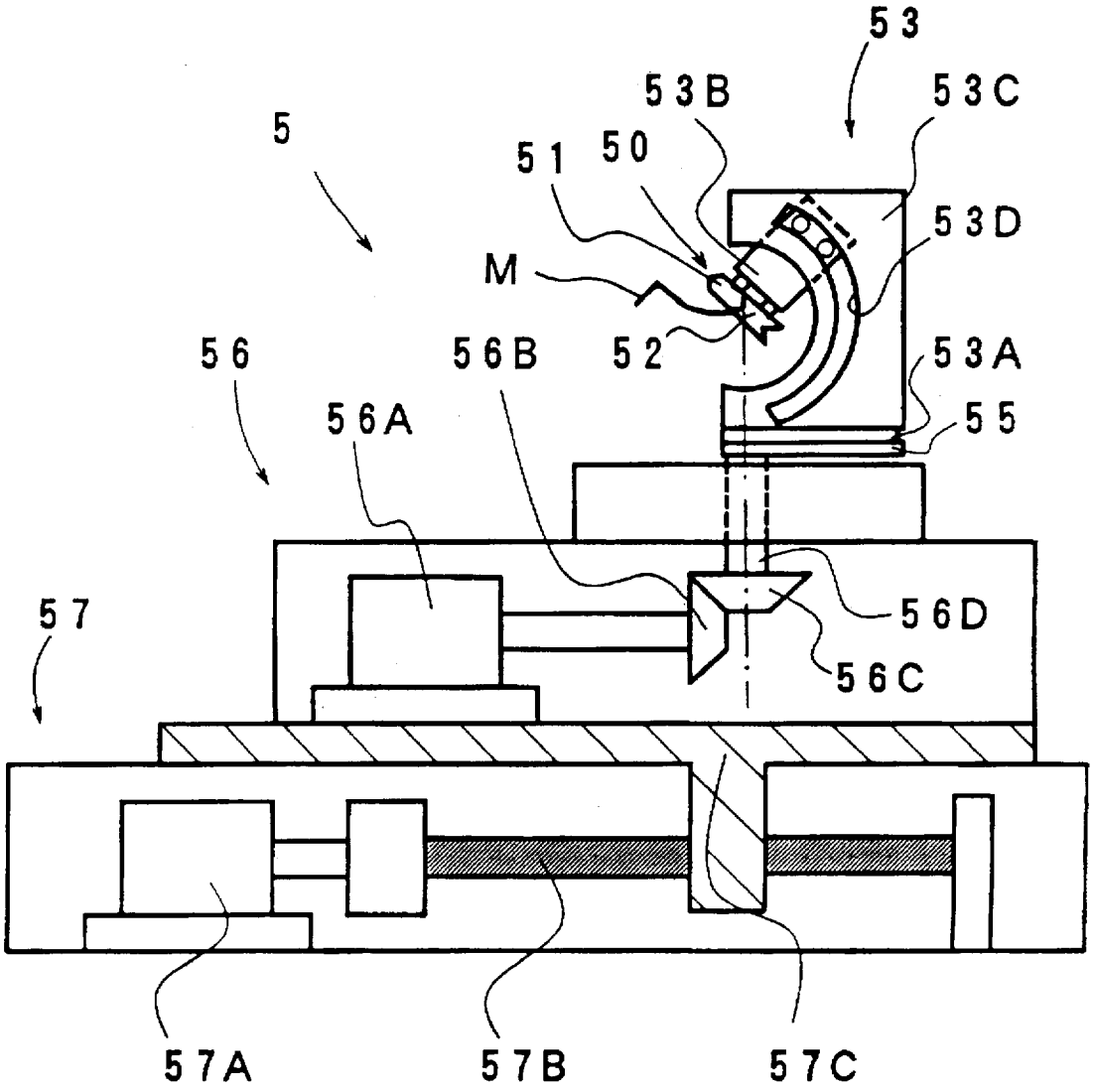
FIG. 8 is a sectional view showing a detailed structure of the transfer apparatus in the gradual changing servo unit as a second preferred embodiment of the invention.
Figure 9:
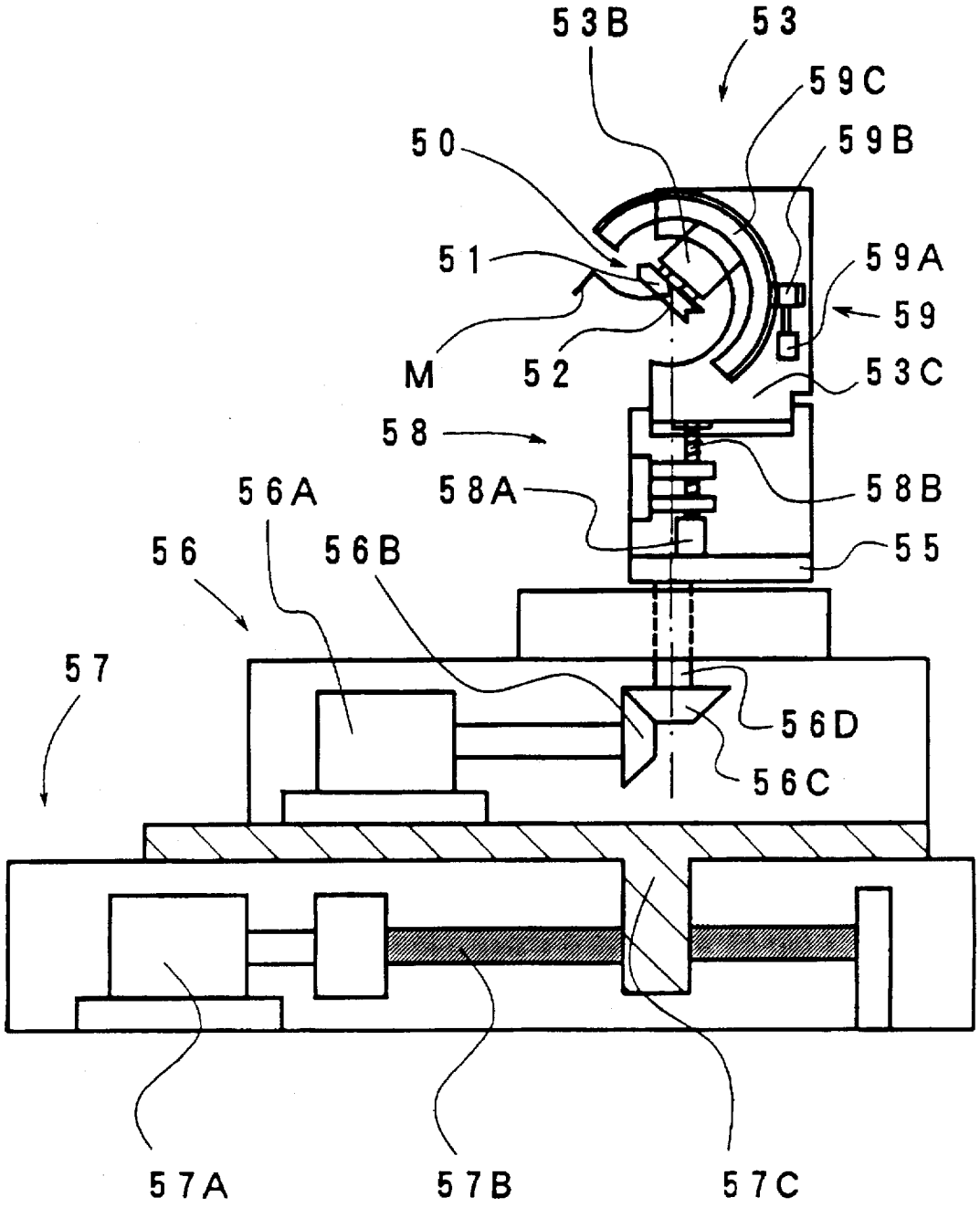
FIG. 9 is a sectional view showing a transfer apparatus of the gradual changing servo unit and a detailed structure of an attitude control apparatus, respectively.
Figure 10:
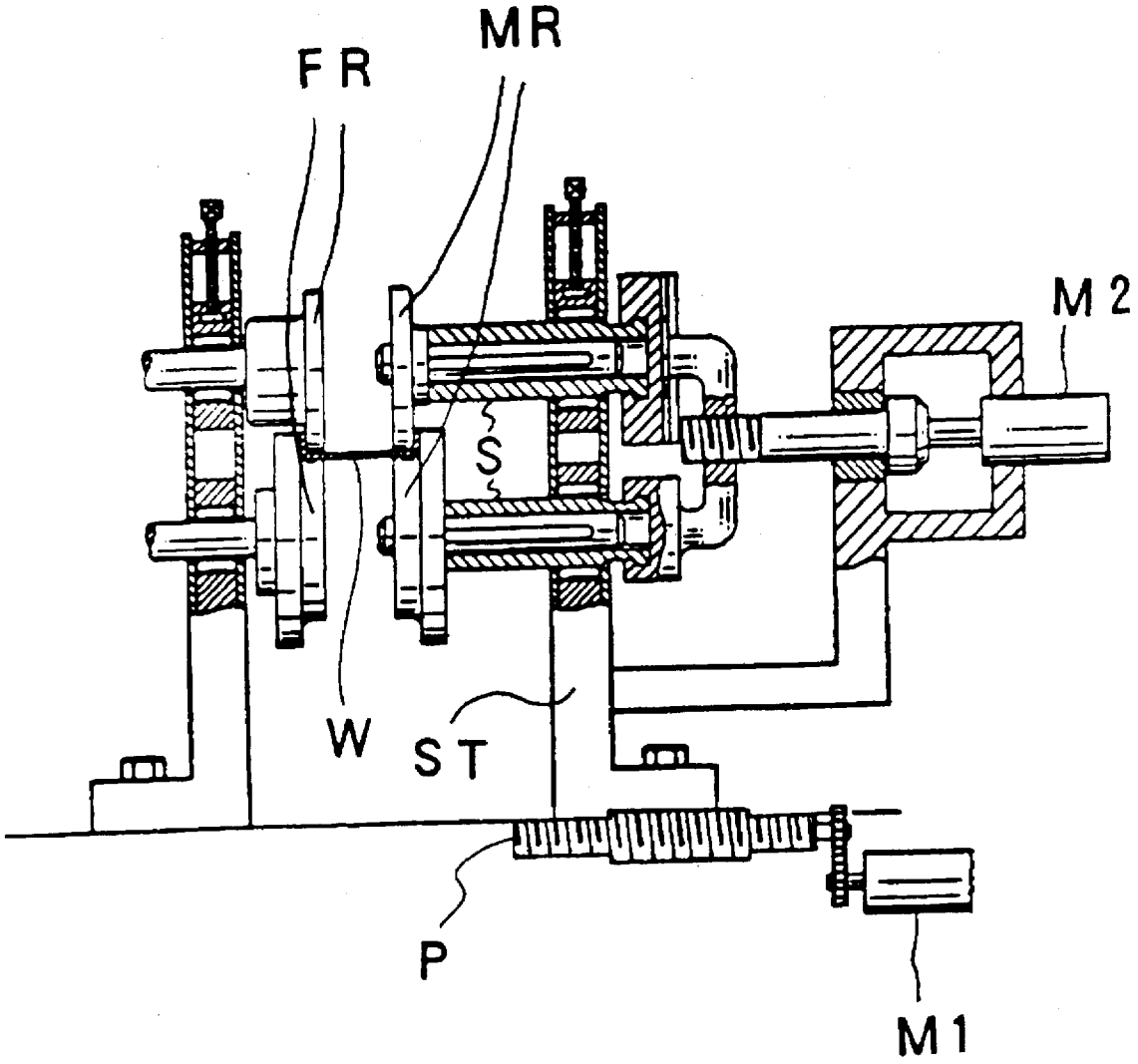
FIG. 10 (PRIOR ART)
FIG. 10 is a sectional view showing a prior art apparatus.
Figure 11:
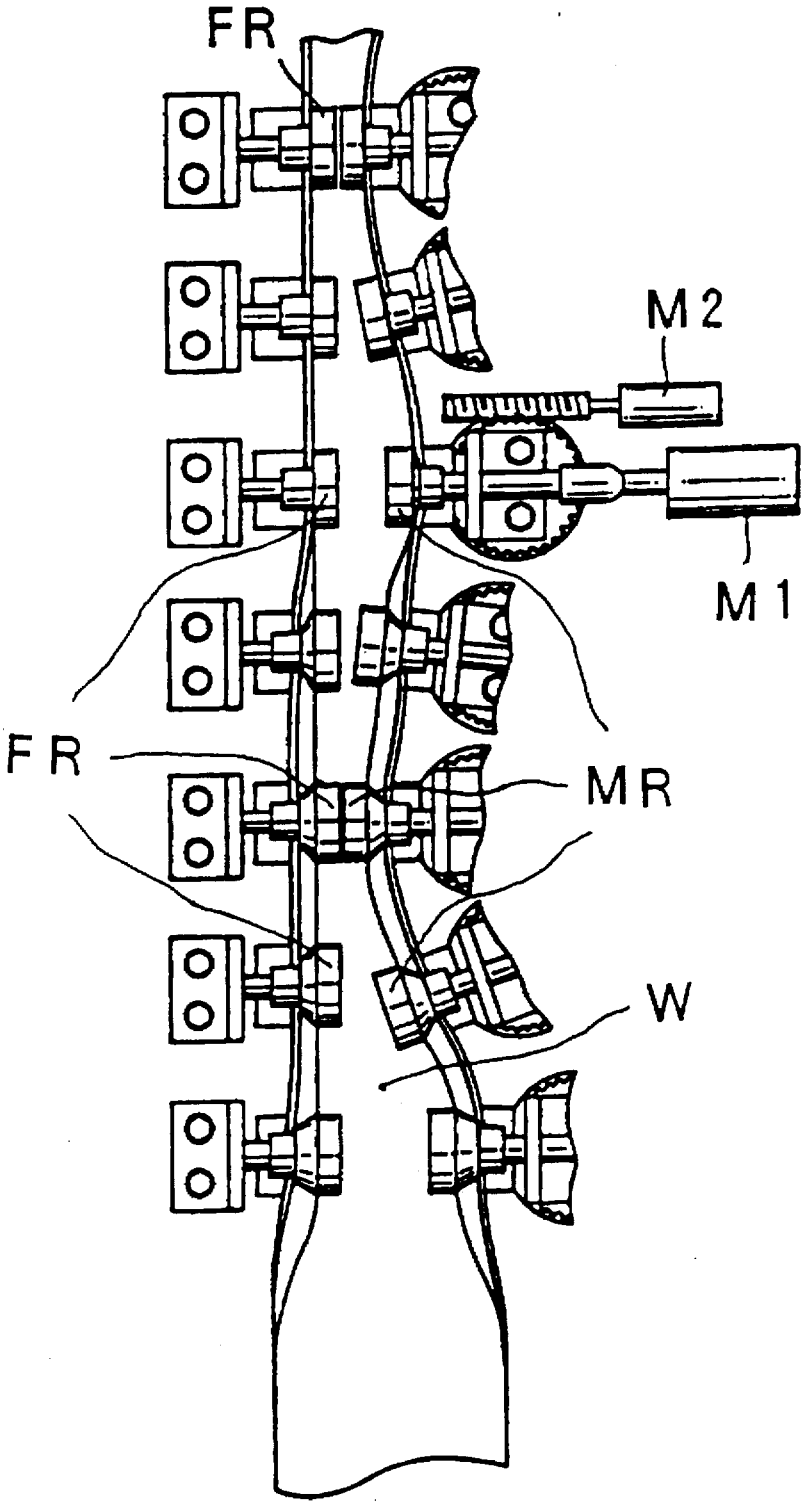
FIG. 11 (PRIOR ART)
FIG. 11 is a plan view showing a prior art apparatus.

As shown in FIGS. 7 and 8, the gradual changing servo unit 5 comprises: upper and lower gradual changing rolls 51 and 52 which constitute the forming rolls for clamping and rotatably supporting the molding M, a rotary drive mechanism 56 that includes a rotary servo motor for controlling a rotation of a rotary plate 55 which supports a supporting portion 53 for freely supporting the changing forming rolls 51 and 52 in a height and at an angle, through a spacer 54 and a linear servo motor 57 comprising a linear servo motor for controlling a position of the molding M of a rotary plate in its width direction including a controller and a detection sensor. The detection sensor detects the standard hole of the molding M and the upper and lower gradual changing rolls 51 and 52 rotate without driving within the angles of several tens of degrees, while sliding in the width of the molding M in order to form the gradual changing section of the molding M.

The linear drive mechanism 57 is constructed to a T-letter table 57C geared with an axis of rotation 57B attached with a groove portion in the exterior rotatably driven by a linear servo motor 57A to be movable in correspondence with the position of the end face of the molding M in its width direction.

In the rotary drive mechanism 56 described above composed of the roll transfer apparatus, an axis of rotation 56D is integrated into a second bevel gear 56C geared with each other in a vertical relation in a first bevel gear 56B rotated and driven by a rotary servo motor 56A provided at the one end of the T-letter table 57C and locked to a rotary plate 55 constituting a supporting apparatus in a solid one piece. This structure results in a rotatable constitution of the supporting apparatus 53 through the rotary plate 55.

The supporting apparatus 53 is constituted so as to allow a height thereof to be adjustable by the spacer 53A locked to the rotary plate 55. Further, this allows the gradient angle of the upper and lower gradual forming rolls 51 and 52 to be varied by engaging a supporting portion 53B to a new moon slot formed with a supporting base 53C having a U shape. As a result, a contact point of the upper and lower gradual changing rolls 51 and 52 is always positioned to the point on the shaft center of the axis of rotation 56D.

The measuring unit 1 provided to the final forming portion for finishing the gradual changing sectional forming makes it possible to compensate the slide and rotating angle of the gradual changing servo unit 5 by measuring the pitch of the standard hole formed by pierce processing to calculate its elongation of the molding M and to feed back the percentage of elongation (%) to the controller of the gradual changing servo unit 5.

In the roll transfer apparatus in the roll forming apparatus of the second preferred embodiment, when a half-formed molding M formed in a constant section and the forming standard face of a plate-like molding M is supplied in its basic forming portion, the encoder 14 the measuring unit 1 measures a formed length, inputs the resulting signal into the pierce unit 2, and forms a standard hole into the molding M by pierce processing with a punch 22 of the pierce unit 2 and a die 21.

The trimming unit 3 detects the position of a standard hole of the molding M and calculates both a flange face position of the molding M to be gradually changed and a forming velocity signal of the molding M. The molding M is formed into a gradual changing flange by rotating the roll curers 31 and 32 composed of the gradual changing trimming rolls within the angle of several tens of degrees while sliding in the width direction of the molding M.

The tension unit 4 at the most upstream position composed of a trimming tension unit affords a constant tension to the molding M in order to prevent the slack produced at the time of forming the gradual changing flange.

The forming rolls 51 and 52 in the gradual changing servo unit 5 are provided between the neighboring tension units 4 side by side and alternately to the right or left in the width direction of the molding M. The forming rolls 51 and 52 slide in the width direction of the molding M by the linear drive mechanism 57 by detecting a standard hole of the molding M using the detection sensor, and form the gradual changing section of the molding M by being rotated within the angle of several tens of degrees by the rotary driving mechanism 56 corresponding to the angles of the side end face of the molding M.

Incidentally, in the present preferred embodiment, the gradual changing servo units 5 are arranged one by one alternately to the right or left in the width direction thereof. However, there is no problem even if a plurality of gradual changing servo units are arranged to only one side of it.

The rotary drive mechanism 56 transfers the T-letter table 57C in the width direction of the molding M by allowing the linear servo motor 57A described above to rotate the axis of rotation 57B.

The rotary drive mechanism 56 rotates the axis of rotation 56D and the supporting apparatus 53 through second bevel gear 56C by rotating the first bevel gear 56B corresponding to the angle of the forming end face in the width direction of the molding M against the feed direction of the molding M by means of the rotary servo motor 56A on the T-letter table 57C positionally controlled in the width direction of the molding M based on the linear drive mechanism 57. However, since a contact point of the upper and lower gradual changing forming rolls 51 and 52 with the molding M is supported by the supporting apparatus 53 so as to be positioned at the extended line of the shaft center of the axis of rotation 56D, the position of the contact point does not change even if the gradual changing rolls 51 and 52 may rotate.

The neighboring of adjacent tension units 4 side by side at this time form a constant section for securing its forming balance, and remove the slack of the molding M by clamping the gradual changing servo unit 5 and affording a constant tensile force to the molding M by means of the upper and lower rolls 41 and 42.

The measuring unit 1 arranged at the position after the gradual changing and sectional forming is over can also correct the slid quantity and rotating angle of each gradual changing servo unit 5 corresponding to the percentage of elongation obtained by measuring the pitch of a standard hole, calculating the elongation accompanies by the gradual changing forming of the molding M, and feeding back the resulting percentage of elongation to each gradual changing servo unit 5.

Furthermore, the apparatus of the second preferred embodiment results in the forming point of the gradual changing forming rolls 51 and 52 not changing even though the rotary drive mechanism 56 may control the angle of the gradual changing forming rolls 51 and 52 corresponding to the angle in the feed direction of the forming end face of the molding M to be formed, since the linear drive mechanism 57 transfers the T-letter table 57C corresponding to the width of the molding M and the supporting apparatus 53 supports the gradual changing forming rolls 51 and 52 such that a contact point of the gradual changing forming rolls 51 and 52 with the molding M may correspond to the axis of rotation 56D.

Still further, the apparatus of the second preferred embodiment makes it possible to form and gradually change the both end portions of the molding M in the axial direction thereof and allows the gradual changing roll unit 50 to form a narrow-sized molding M as well, since the gradual changing servo units 5 are arranged between the neighboring tension units to each other and alternately to the right or left in the width direction of the molding M.

In addition, the apparatus of the second preferred embodiment prevents the sliding of the upper and lower gradual changing rolls 51 and 52 on the molding M and then inhibits the formation of scratches accompanied by the above sliding, since the supply of the molding M is carried out by the upper and lower rolls 41 and 42 in the tension unit 4 and the upper and lower gradual changing rolls 51 and 52 for carrying out the gradual changing forming are arranged to be of a driven type by undrivability.

Furthermore, the roll attitude control apparatus in the roll forming apparatus of the second preferred embodiment enables a stable forming process since the abovementioned gradual changing rolls 51 and 52 in the gradual changing servo unit 5 accompany and rotate by the transferring of the molding M due to a driven type. Accordingly, the gradual changing rolls 51 and 52 are positioned in parallel with the formed face at a time of gradual changing section formation.

Moreover, the roll attitude control apparatus in the roll forming apparatus of the second preferred embodiment makes it possible to improve the accuracy in section by carrying out the gradual changing section formation along the gradual changing flange, since each gradual servo unit 5 is feed-back controlled corresponding to the variations in the percentage of elongation monitored when any elongation is generated by the gradual changing forming and both the slid quantity and the rotating angle of the gradual changing rolls 51 and 52 are corrected thereby.

Furthermore, the roll forming apparatus of the second preferred embodiment makes it possible to form the section gradually changing in the height direction thereof and to respond readily to a pass line change and a flower change for solving the torsion, warp and marginal wave phenomena of the molding M in a longitudinal direction thereof. Being flexible, the roll forming apparatus requires no production of new gradual changing rolls, reduces the stages of the gradual changing rolls, and improves the accuracy in each dimension of the products, since the gradual changing rolls 51 and 52 are supported to the supporting portion 53 ascendably or descendably and inclinably.

EMBODIMENT 3

As shown in FIGS. 1 through 7 and FIG. 9, a roll forming apparatus of the third preferred embodiment comprises a measuring unit 1 for measuring the formed length of a gradual section changed material that is a material to be formed; a pierce unit 2 for perforating a gradual changing and trimming standard hole; a gradual changing and trimming unit 3 for forming a gradual changing flange; a plurality of tension units 4 for feeding the gradual section changed material provided at predetermined intervals to the right side in FIG. 1; and a plurality of gradual changing servo units 5 provided with a roll transfer apparatus comprising a supporting apparatus 53 for supporting forming rolls 50 and a linear transfer mechanism 57T for transferring the supporting apparatus 53 in the width direction of a molding M so as to correspond a contact point of a rotary drive mechanism 56 for rotationally driving a driven forming roll 50, which is provided between the tension rolls 41 and 42 of the neighboring tension unit and alternately to the right or left in the width direction of the molding M, i.e., a gradual section changed material, while centering on an axis of rotation thereof with both the forming rolls 50 and the molding M, to the axis of rotation, a height adjusting mechanism 58 for adjusting the height of the forming rolls 50 and a gradient adjusting mechanism 59 for adjusting the gradient of the forming rolls 50. In the roll forming apparatus, a roll attitude control apparatus provides the height adjusting mechanism 58 for adjusting the height of the forming roll 50 in the supporting apparatus 53 within the gradual changing servo unit 5 and the gradient adjusting mechanism 59 for adjusting the gradient angle of the forming rolls 50.

The measuring unit 1 is provided to the most upstream position of the gradual changing and sectional forming portion as shown in FIG. 3. The measuring unit 1 comprises upper and lower rotary plates 11 and 12 for clamping half-formed molding M forming both a constant sectional portion and a forming standard face of the molding M as a plate material, i.e., a material to be formed, by a basic forming portion; and an encoder 14 for rotating itself and communicating to the lower rotary plate 11 through a belt 13. Further, the measuring unit 1 outputs signals after detecting the forming length of the molding M.

As shown in FIG. 4, the pierce unit 2 is provided to the downstream of the measuring unit 1, and comprises: a die for mounting a molding M thereon; a punch 22 placed opposing to the die 21; a clamp 23 for locking the punch 22; and an air cylinder 24 for moving vertically the clamp 23. Also, the pierce unit 2 carries out pierce processing based on the signals from the measuring unit 1, and perforates a round standard hole on the center line of the molding M at a constant pitch.

As shown in FIG. 5, the gradual changing and trimming unit 3 comprises: upper and lower roll cutters 31 and 32 for clamping the molding M, a rotary servo motor 34 for rotating and controlling a rotary plate 33 mounting an apparatus for supporting the roll cutters 31 and 32, a linear servo motor 35 for controlling a position in the width direction of the molding M of the rotary plate 33 and a controller. The gradual changing and trimming unit 3 detects the standard hole position of the molding M to calculate both a flange face position of the molding M to be gradually changed and the forming velocity signal of the molding M. Then, the gradual changing and trimming rolls rotate within the angle of several tens of degrees while sliding the width direction of the molding M so as to carry out the processing of the molding into a gradual changing flange.

As shown in FIG. 6, the tension unit 4 comprises: the upper and lower rolls 41 and 42 for clamping the molding M, a stand 43 for supporting the upper and lower rolls rotatably and a drive portion 44 comprising a drive motor for driving the lower roll 42. The tension unit 4 feeds the molding M to the right side in FIG. 1, and provides for the forming of a constant section area and tensile force to the molding M by means of the upper and lower rolls 41 and 42 in order to secure a forming balance thereof, resulting in preventing the slack of the molding M as a plate material.

Each tension unit 4 at a first or second stage provided upstream or downstream of the gradual changing and trimming unit 3 acts as a trimming tension unit and prevents the slack produced by the gradual changing trimming.

As shown in FIGS. 7 and 8, the gradual changing servo unit 5 comprises: upper and lower gradual changing rolls 51 and 52 for constituting the forming rolls clamping the rotatably supported molding M. A rotary drive mechanism 56 comprising a rotary servo motor for rotatably controlling a supporting apparatus 53 attached with the attitude control apparatus for controlling within a perpendicular plane the attitudes of the gradual changing forming rolls 51 and 52 composed of a gradient adjusting mechanism 59 for adjusting the gradient of a height adjusting mechanism 58 for adjusting the heights of the upper and lower rolls 51 and 52 and those of the gradual changing rolls 51 and 52, and a linear drive mechanism 57 comprising a linear servo motor for controlling a position of the molding M of a rotary plate in its width direction including a controller and a detection sensor, and the detection sensor detects the standard hole of the molding M and the upper and lower gradual changing rolls 51 and 52 rotate within the angles of several tens of degrees while sliding in the width of the molding M in order to form the gradual changing section of the molding M.

The linear drive mechanism 57 constituting the roll transfer apparatus is composed of the constitution allowing a T-letter table 57C geared with an axis of rotation 57B attached with a groove portion in the exterior rotatably driven by a linear servo motor 57A to be movable corresponding to the position of the end face of the molding M in its width direction.

In the rotary drive mechanism 56 composed of the above roll transfer apparatus, an axis of rotation 56D is integrated into a second bevel gear 56C geared with each other in a vertical relation in a first bevel gear 56B rotated and driven by a rotary servo motor 56A provided to the one end of the T-letter table 57C and locked to a rotary plate 55 constituting a supporting apparatus in a solid one piece, resulting in giving such a rotatable constitution of the supporting apparatus 53 on the horizontal face determined by the rotary plane 55 by way of the rotary plane 55.

The supporting apparatus 53 is constituted so as to allow a height thereof to be adjustable by the height adjusting mechanism 58 locked to the rotary plate 55, and further so that the gradient angle of the upper and lower gradual forming rolls 51 and 52 may be varied by the gradient adjusting mechanism 59 with a supporting portion 53B supporting a contact point of the upper and lower gradual changing rolls 51 and 52 and a supporting base 53C having a left-side convex shape so as to always position the point on the shaft center of the axis of rotation 56D.

The height adjusting mechanism 58 for constituting the roll attitude control apparatus is constituted so as to allow the lower portion of the supporting base having a left-side convex shape of the supporting apparatus 53 to gear with an axis of rotation 58B attached with a groove to the exterior rotated and driven based on an input signal by an ascendable and descendable servo motor 58A locked to the rotary plate 55, resulting in giving the ascendable and descendable constitution of a supporting base 53C for supporting the upper and lower gradual changing forming rolls 51 and 52 corresponding to the rotation of the axis of rotation 58B.

The gradient adjusting mechanism 59 for constituting the roll attitude control apparatus controls the gradient of a crescent rack plate 59C geared with a pinion gear 59B by the rotation of the pinion gear 59B rotated and driven based on an input signal by an inclined and movable servo motor 59A locked to the supporting base 53C. The upper and lower gradual changing forming rolls 51 and 52 are supported thereby to the rack plate 59C by way of the supporting portion 53B, resulting in being able to control the gradient of the upper and lower gradual forming rolls 51 and 52 in a perpendicular plane thereof centering on the forming point.

The measuring unit 1 provided to the final forming portion for finishing the gradual changing sectional forming makes it possible to compensate for the slide and rotating angle of the gradual changing servo unit 5 by measuring the pitch of the standard hole formed by pierce processing to calculate its elongation of the molding M and to feed back the percentage of elongation (%) to the controller of the gradual changing servo unit 5.

In the roll attitude control apparatus in the roll forming apparatus of the third preferred embodiment having the above construction, when a half-formed molding M formed in a constant section and the forming standard face of a plate-like molding M is supplied in its basic forming portion, the encoder 14 in the measuring unit 1 measures a formed length, and inputs the resulting signal into the pierce unit 2. The pierce unit 2 then forms a standard hole into the molding M by means of a punch 22 of the pierce unit 2 and a die 21.

The trimming unit 3 detects the position of a standard hole on the molding M and calculates both a flange face position of the molding M to be gradually changed and a forming velocity signal of the molding M. The molding M is formed into a gradual changing flange by rotating the roll cutters 31 and 32 composed of the gradual changing trimming rolls within the angle of several tens of degrees while sliding in the width direction of the molding M.

The tension unit 4 at the most upstream position composed of a trimming tension unit affords a constant tension to the molding M in order to prevent the formation of slack at the time of forming the gradual changing flange.

The forming rolls 51 and 52 in the gradual changing servo unit 5 are provided between the neighboring tension units 4 side by side and alternately to the right or left in the width direction of the molding M. The forming rolls 51 and 52 slide in the width direction of the molding M by the linear drive mechanism 57 detecting a standard hole of the molding M by means of the detection sensor. The forming of the gradual changing section of the molding M is then carried out by rotation within the angle of several tens of degrees of the rotary driving mechanism 56 corresponding to the angles of the side end face of the molding M. Incidentally, in the present preferred embodiment, the gradual changing servo units 5 are arranged one by one alternately to the right or left in the width direction thereof. However, there is no problem even if a plurality of gradual changing servo units are arranged on only one side of it.

The linear rotary drive mechanism 56 transfers the T-letter table 57C in the width direction of the molding M by allowing the linear servo motor 57A described above to rotate the axis of rotation 57B.

The rotary drive mechanism 56 rotates the axis of rotation 56D and the supporting apparatus 53 through a second bevel gear 56C by rotating the first bevel gear 56B corresponding to the angle of the forming end face in the width direction of the molding M against the feed direction of the molding M by means of the rotary servo motor 56A on the T-letter table 57C positionally controlled in the width direction of the molding M based on the linear drive mechanism 57. However, since a contact point of the upper and lower gradual changing forming rolls 51 and 52 with the molding M is supported by the supporting apparatus 53 so as to be positioned at the extended line of the shaft center of the axis of rotation 56D, the position of the contact point does not change even if the gradual changing rolls 51 and 52 may rotate.

The height adjusting mechanism 58 adjusts the upper and lower gradual changing forming rolls 51 and 52 in an optimum height thereof in order to make it possible to form the gradual changing section in its height direction while corresponding to the variations in height of the molding M and to prevent the torsion, warp and marginal wave phenomena of the molding M in a longitudinal direction thereof (around a longitudinal axis).

The gradient adjusting mechanism 59 adjusts the upper and lower gradual changing forming rolls 51 and 52 at an optimum gradient angle in order to respond to the variations in gradient of the molding M and further to prevent the torsion, warp and marginal wave phenomena of the molding M in a longitudinal direction thereof.

The neighboring tension units 4 side by side at this time form a constant section for securing its forming balance, and remove the slack of the molding M by clamping the gradual changing servo unit 5 and affording a constant tensile force to the molding M by means of the upper and lower rolls 41 and 42.

The measuring unit 1 arranged at the position after the gradual changing and sectional forming is over can also correct the slid quantity and rotating angle of each gradual changing servo unit 5 corresponding to the percentage of elongation obtained by measuring the pitch of a standard hole, calculating the elongation accompanied by the gradual changing forming of the molding M and feeding back the resulting percentage of elongation to each gradual changing servo unit 5.

The roll attitude control apparatus in the roll forming apparatus of the third preferred embodiment having the above-mentioned effect realizes an optimum height and gradient corresponding to the height of the molding M and its gradient on the perpendicular plane, and further realizes an optimum height and gradient so as to prevent the torsion, warp and marginal wave phenomena of the molding M in a longitudinal direction thereof. The height adjusting mechanism 58 adjusts the height of the upper and lower gradual changing forming rolls 51 and 52. The gradient adjusting mechanism 59 also adjusts the gradient of the upper and lower gradual changing forming rolls 51 and 52 on a perpendicular plane thereof.

Furthermore, the apparatus of the third preferred embodiment makes it possible to form the section gradually changing in a height direction thereof and responding readily to a pass line change and a flower change for solving the torsion, warp and marginal wave phenomena of the molding M in a longitudinal direction thereof. With such flexibility, the apparatus requires no production of new gradual changing rolls, reduces the stages of the gradual changing rolls, and improves the accuracy in each dimension of the products, since the gradual changing rolls 51 and 52 are supported on the supporting portion 53 ascendably or descendably and inclinably.

Furthermore, the apparatus of the third preferred embodiment described above allows the forming point of the gradual changing forming rolls 51 and 52 to not change even though the rotary drive mechanism 56 may rotate the gradual changing forming rolls 51 and 52 corresponding to the angle of the forming end face of the molding M. The linear drive mechanism 57 transfers the T-letter table 57C corresponding to the width of the molding M, and the supporting apparatus 53 supports the gradual changing forming rolls 51 and 52 so that a contact point of the gradual changing forming rolls 51 and 52 with the molding M may correspond to the axis of rotation 56D.

Still further, the apparatus of the third preferred embodiment makes it possible to form and gradually change both end portions of the molding M in an axial direction thereof and to allow the gradual changing roll unit 50 to form a narrow-sized molding M as well. The gradual changing servo units 5 are arranged between the neighboring tension units to each other and alternately to the right or left in the width direction of the molding M.

In addition, the apparatus of the third preferred embodiment prevents the sliding of the upper and lower gradual changing rolls 51 and 52 on the molding M, and then inhibits the formation of scratches accompanied by the above sliding. The supplying of the molding M is carried out by the upper and lower rolls 41 and 42 in the tension unit 4 and the upper and lower gradual changing rolls 51 and 52 for carrying out the gradual changing forming are arranged to be of a driven type by undrivability.

Furthermore, the roll attitude control apparatus in the roll forming apparatus of the third preferred embodiment enables a stable forming since the above-mentioned gradual changing rolls 51 and 52 in the gradual changing servo unit 5 accompany and rotate by the transferring of the molding M due to a driven type. Accordingly, the gradual changing rolls 51 and 52 are positioned in parallel with the formed face at the time of gradual changing section formation.

Moreover, the roll attitude control apparatus in the roll forming apparatus of the third preferred embodiment makes it possible to improve the accuracy in section by carrying out the gradual changing section forming along the gradual changing flange. Each gradual servo unit 5 is feedback controlled corresponding to the variations in the percentage of elongation monitored when any elongation is generated by the gradual changing formation. Both the slid quantity and the rotating angle of the gradual changing rolls 51 and 52 are corrected thereby.

The preferred embodiments are simply exemplified for explaining the present invention, and the present invention is not limited only to these preferred embodiments. It should be understood, however, that any alterations and additions will be possible so long as they may not be opposed to the technical ideas of the present invention recognizable by any skilled persons in this technical field from these patent claims, detailed description of the invention and the description of the drawings.

What is claimed is:

1. A roll forming apparatus comprising:

tension rolls for feeding a material along a longitudinal direction thereof, said tension rolls being arranged at predetermined intervals and being driven; and a plurality of forming rolls for forming said material, said plurality of forming rolls being arranged on both sides of said material in a width direction and along a feeding direction of said material, each of said plurality of forming rolls further being positioned between adjacent tension rollers, wherein said plurality of forming rolls are alternatingly positioned along the feeding direction of said material relative to each other such that a first one of said forming rolls is positioned between a first set of adjacent tension rolls along a first side of said material, with a subsequent forming roll being positioned along a second side of said material and between a set of adjacent tension rolls subsequent to said first set of adjacent tension rolls whereby only one side of said material between a set of adjacent tension rolls is formed by corresponding forming rolls.

2. A roll forming apparatus according to claim 1, further comprising:

a roll transfer apparatus that comprises a rotary drive mechanism for controlling an angle of said forming rolls relative to said longitudinal feeding direction of said material centering on an axis of rotation thereof, a supporting apparatus for said forming rolls and said rotary drive mechanism so as to correspond the axis of rotation in said rotary drive mechanism to a contact point of said forming rolls with said material to be formed, and a linear transfer mechanism for positionally transferring said supporting apparatus and said rotary drive mechanism along the width direction of said material to be formed.

3. A roll forming apparatus according to claim 2, further comprising:

a roll attitude control apparatus that comprises a height adjusting apparatus for adjusting the height of said forming rolls relative to a height of a forming portion of the material to be formed, and a gradient adjusting apparatus for adjusting the gradient angle of said forming rolls to correspond to an inclined angle of a formed member from the material to be formed relative to a plane perpendicular to the material.

4. A roll forming apparatus according to claim 1, wherein said tension rolls include upper and lower rolls for clamping said material to be formed, a stand for rotatably supporting said upper and lower rolls, and a drive portion having a drive motor for rotatably driving said lower roll.

5. A roll forming apparatus according to claim 4, further comprising:

a gradual changing servo unit that comprises said forming rolls having upper and lower gradual changing rolls for clamping the rotatably supported material to be formed, a rotary servo motor for controlling a rotation of a rotary plate which supports a supporting portion relative to said longitudinal feeding direction of said material, said supporting portion freely supporting the gradual changing rolls at a height and an attitude relative to said material through a spacer, and a linear servo motor for controlling a position of said rotary plate along a width direction of said material to be formed, said linear servo motor including a controller and a detection sensor, wherein the detection sensor includes means for detecting a standard hole defined on said material to be formed, and said controller controls the position of said rotary plate based on a position of said standard hole detected by said detection sensor, whereby the upper and lower gradual changing rolls rotate within an angle range of several tens of degrees relative to said longitudinal feeding direction of said material to be formed while positionally sliding along the width direction of said material to be formed in order to form a gradual changing section of said material to be formed.

6. A roll forming apparatus according to claim 2, wherein said linear transfer mechanism comprises means for positionally transferring a supporting apparatus along the width direction of said material to be formed so as to correspond a contact point of said rotary drive mechanism with said material, said rotary drive mechanism comprising a rotary servo motor for controlling the angle of said forming rolls relative to said longitudinal feeding direction while centered on said axis of rotation of said rotary drive mechanism, said linear transfer mechanism being positioned between a third set of adjacent tension rolls.

7. A roll forming apparatus according to claim 6, wherein said linear transfer mechanism comprises a linear drive mechanism having a linear axis of rotation with a linear servo motor for driving said supporting apparatus and said rotary drive mechanism along said linear axis of rotation, and a table on which said supporting apparatus and said rotary drive mechanism are mounted, said table being geared to be positionally movable along said linear axis of rotation corresponding to positions of an end face of said material to be formed along said width direction.

8. A roll forming apparatus according to claim 7, wherein said rotary drive mechanism comprises:

a first bevel gear driven by a rotary servo motor provided to an one end of said table and locked to a rotary plate constituting a supporting portion in a solid one piece;

a second bevel gear geared with each other in a vertical relation in said first bevel gear; and an axis of rotation integrated into said second bevel gear.

9. A roll forming apparatus according to claim 8, wherein said supporting apparatus comprises:

a spacer, for adjusting a height thereof, locked to a rotary plate;

a supporting base mounted on said spacer;

a slot formed with said supporting base; and a supporting portion having an upper and lower gradual forming rolls and being engaged to said slot.

10. A roll forming apparatus according to claim 6, further comprising:

a measuring unit for measuring a pitch of said standard hole defined on said material to be formed, said measuring unit including means for calculating an elongation of said material to be formed based on said pitch of said standard hole, and means for compensating sliding and a rotating angle of said based on a calculation of elongation from said calculating means.

11. A roll forming apparatus according to claim 6, further comprising:

a gradual changing servo unit having a roll attitude control apparatus that includes a height adjusting mechanism for adjusting a height of said forming rolls relative to said material to be formed, and a gradient adjusting mechanism for adjusting a gradient of said forming rolls relative to a plane perpendicular to said material to be formed.

12. A roll forming apparatus according to claim 3, wherein said roll attitude control apparatus comprises:

an attitude control apparatus for controlling in perpendicular plane attitudes of said gradual changing forming rolls provided on said gradient adjusting mechanism for adjusting the gradient of said height adjusting mechanism for adjusting heights of said upper and lower rolls.

13. A roll forming apparatus according to claim 12, wherein said height adjusting mechanism comprises:

an axis of rotation attached with a groove to the exterior; and a servo motor, for driving said axis of rotation, locked to said rotary plate, wherein a height of a supporting base having said upper and lower rolls is controlled.

14. A roll forming apparatus according to claim 13, wherein said gradient adjusting mechanism comprises:

an inclined and movable servo motor locked to said supporting base;

a pinion gear driven by said inclined movable servo motor;

a crescent rack plate geared with said pinion gear; and a supporting portion having said upper and lower rolls and being engaged to said crescent rack plate.

15. A roll forming apparatus according to claim 1, wherein said forming rolls are positioned inside of axial ends of said adjacent tension rolls.

* * * * *

UNITED STATES PATENT AND TRADEMARK OFFICE

CERTIFICATE OF CORRECTION

PATENT NO. : 5,722,278
DATED : March 3, 1998
INVENTOR(S) : Horino *et al.*

It is certified that error appears in the above-identified patent and that said Letters Patent is hereby corrected as shown below.

On the title page,

Item [73], please delete "Chubo" and insert in place thereof --Chubu--.

Signed and Sealed this

Ninth Day of November, 1999

*Attest:*

Q. TODD DICKINSON

*Attesting Officer*

*Acting Commissioner of Patents and Trademarks*